US007677903B1

(12) United States Patent
Huang et al.

(10) Patent No.: US 7,677,903 B1
(45) Date of Patent: Mar. 16, 2010

(54) BOARD-TO-BOARD CONNECTOR ASSEMBLY

(75) Inventors: Sheng-Yuan Huang, Tu-Cheng (TW); Yung-Chi Peng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/292,868

(22) Filed: Nov. 28, 2008

(51) Int. Cl.
*H01R 12/00* (2006.01)

(52) U.S. Cl. ..... 439/74; 439/64

(58) Field of Classification Search ..... 439/74, 439/64

See application file for complete search history.

(56) References Cited

U.S. PATENT DOCUMENTS 5,498,167 A * 3/1996 Seto et al. ..... 439/74
5,971,809 A * 10/1999 Ho ..... 439/660
6,338,630 B1 * 1/2002 Dong ..... 439/74
6,805,586 B2 * 10/2004 Akama et al. ..... 439/607.07
6,811,411 B1 * 11/2004 Hirata et al. ..... 439/74
6,884,089 B2 * 4/2005 Obikane et al. ..... 439/74
7,040,904 B2 * 5/2006 Kajimoto ..... 439/74
7,287,988 B1 * 10/2007 Peng et al. ..... 439/74
7,413,444 B2 * 8/2008 Wang ..... 439/74
7,484,969 B2 * 2/2009 Shiu ..... 439/74

* cited by examiner

*Primary Examiner*—Truc T Nguyen
(74) *Attorney, Agent, or Firm*—Rosenberg, Klein & Lee

(57) ABSTRACT

A board-to-board connector assembly includes a receptacle connector having a plurality of first terminals, and a plug connector having a plurality of second terminals. Each of the first terminals has two contact portions located oppositely and each of the second terminals has two contact arms located face-to-face. When the plug connector is mated with the receptacle connector, the contact portions of the first terminal are clipped between the contact arms of the corresponding second terminal to electrically contact the corresponding contact arms tightly such that ensures the first terminal and the corresponding second terminal electrically connected with each other steadily.

8 Claims, 5 Drawing Sheets

BOARD-TO-BOARD CONNECTOR ASSEMBLY

BACKGROUND OF THE INVENTION

1. Field of the Invention

The present invention generally relates to an electrical connector, and more particularly to a board-to-board connector assembly.

2. The Related Art

A conventional board-to-board connector assembly includes a receptacle connector and a plug connector. The receptacle connector has a plurality of first terminals each having a contact portion and the plug connector has a plurality of second terminals each having a contact arm. When the plug connector is mated with the receptacle connector, the contact portion electrically contact the corresponding contact arm to make the first terminal and the corresponding second terminal electrically interconnected. However, the first terminal contacts the corresponding second terminal merely in one single point and without any locking structures. As a result, when the board-to-board connector assembly is shaken in use, the contact portion is apt to depart from the corresponding contact arm that makes signal transmission between the first terminal and the corresponding second terminal broken easily. Therefore, a board-to-board connector assembly capable of overcoming the above-mentioned problems is required.

SUMMARY OF THE INVENTION

An object of the present invention is to provide a board-to-board connector assembly including a receptacle connector and a plug connector. The receptacle connector includes a receptacle housing defining a plurality of first passageways, and a plurality of first terminals received in the corresponding first passageways and each having a first base portion extending longitudinally. The first base portion extends upward to form a propping portion. Two sides of a top end of the propping portion protrude oppositely to form two contact portions stretching out of the corresponding first passageway. The plug connector is mated with the receptacle connector and includes a plug housing defining a plurality of second passageways, and a plurality of second terminals received in the corresponding second passageways and each having a second base portion extending longitudinally. The second base portion extends downward to form two contact arms spaced from each other. Two bottom ends of the two contact arms protrude face-to-face to respectively form an interference portion stretching out of the corresponding second passageway. Wherein the contact portions of the first terminal pass the interference portions of the corresponding second terminal to be clipped between the corresponding contact arms and electrically contact the corresponding contact arms respectively.

As described above, the contact portions of the first terminal are clipped between the contact arms of the corresponding second terminal to electrically contact the corresponding contact arms tightly such that ensures the first terminal and the corresponding second terminal electrically connected with each other steadily. Furthermore, the interference portions have an interference with the corresponding contact portions that prevents the first terminal from departing from the corresponding second terminal and further ensures the first terminal and the corresponding second terminal electrically connected with each other steadily even if the board-to-board connector assembly is shaken.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
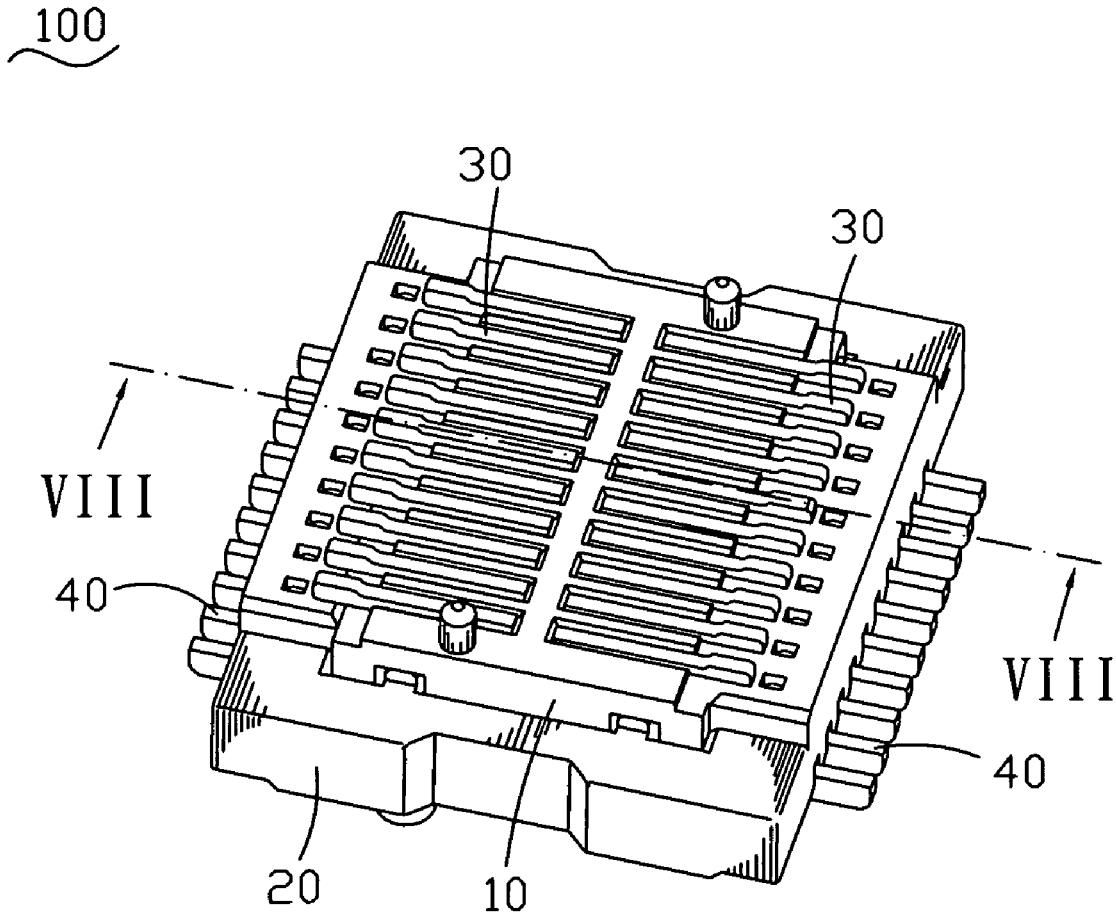
FIG. 1 is a perspective view of a board-to-board connector assembly in accordance with the present invention.
Figure 2:
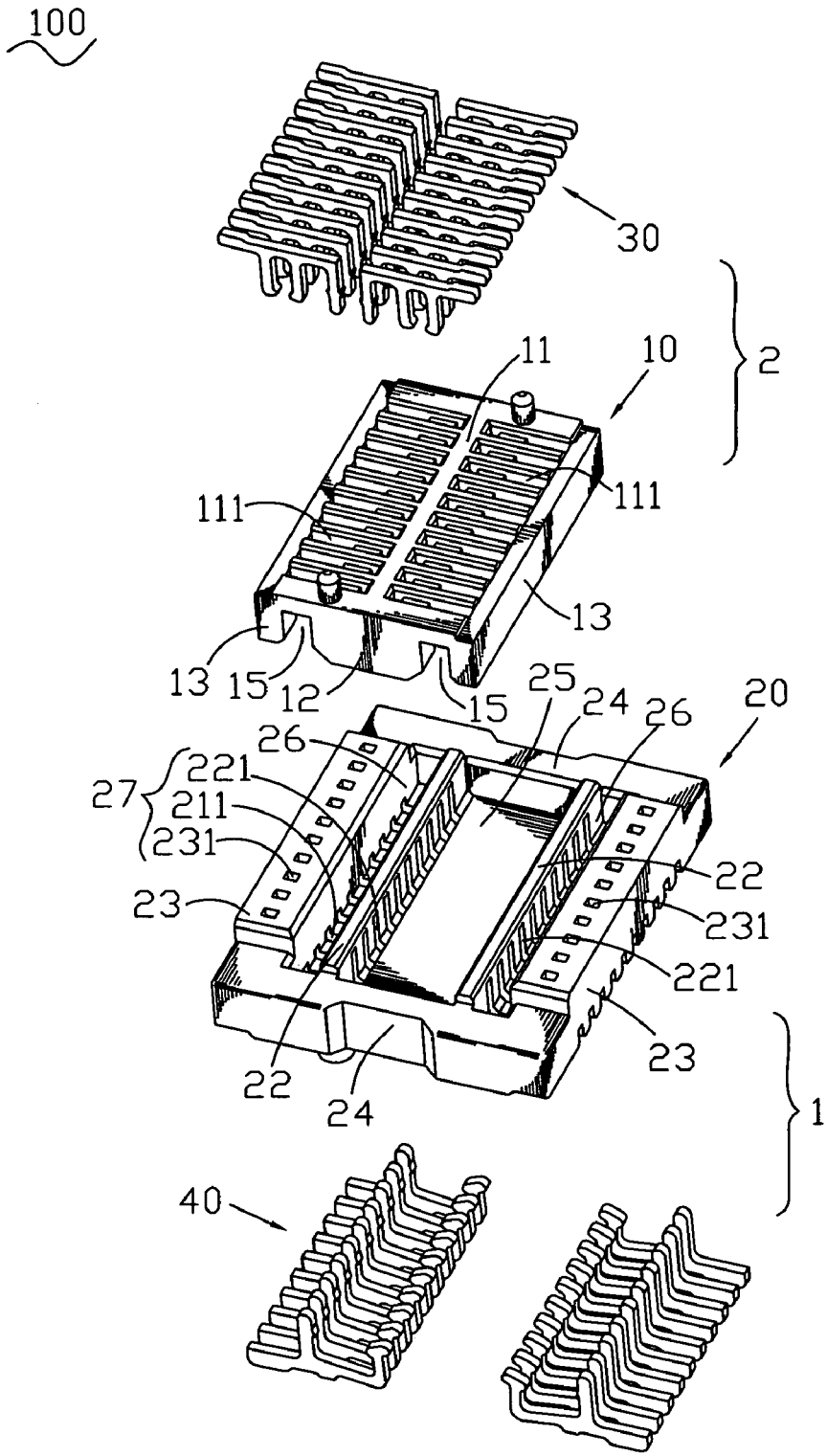
FIG. 2 is an exploded view of the board-to-board connector assembly of FIG. 1.
Figure 3:
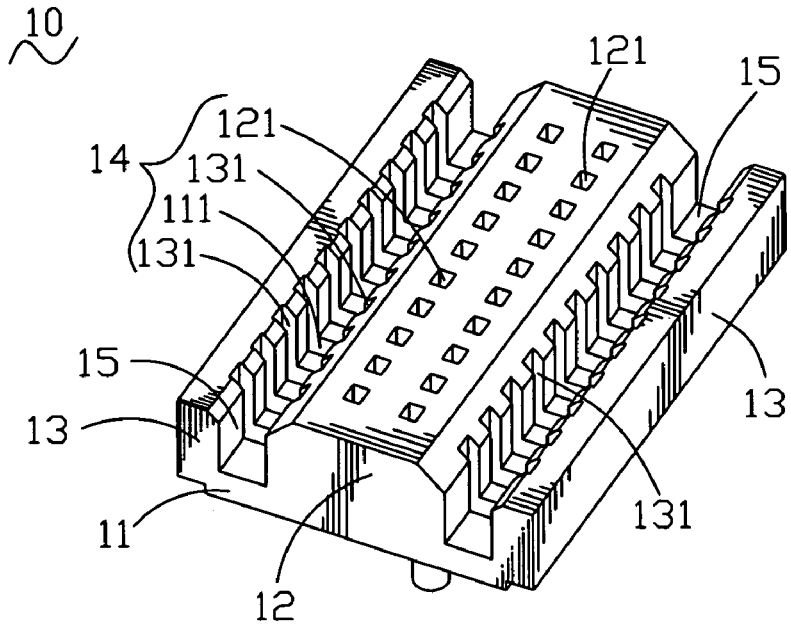
FIG. 3 is a perspective view of a plug housing of the board-to-board connector assembly of FIG. 1.

With reference to FIG. 1 and FIG. 2, a board-to-board connector assembly 100 in accordance with the present invention includes a receptacle connector 1 and a plug connector 2 mated with the receptacle connector 1.

Referring to FIGS. 2, 4, 6 and 7, the receptacle connector 1 includes a receptacle housing 20 and a plurality of first terminals 40 disposed in the receptacle housing 20 respectively.

In FIG. 2, the receptacle housing 20 has a rectangular base board 21 disposed levelly. Two opposite sides of the base board 21 protrude upward to form a pair of sidewalls 23 extending longwise. Two opposite ends of the base board 21 protrude upward to form a pair of end-walls 24. The base board 21 further protrudes upward to form two insert boards 22 which extend longwise between the two sidewalls 23 and are respectively adjacent to the corresponding sidewalls 23. Two opposite ends of each insert board 22 are connected with the corresponding end-walls 24. So a receiving recess 25 is formed among the insert boards 22 and the end-walls 24, and two receiving spaces 26 are respectively formed among the insert boards 22, the corresponding sidewalls 23 and the end-walls 24.

Figure 4:
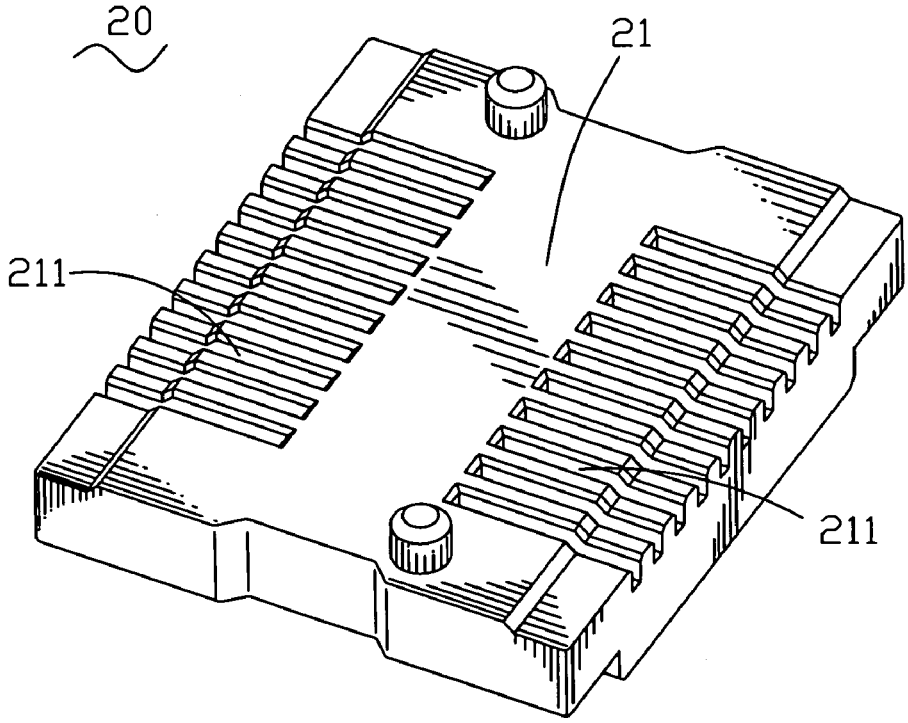
FIG. 4 is a perspective view of a receptacle housing of the board-to-board connector assembly of FIG. 1.

In FIG. 4, each of the insert boards 22 defines a plurality of first receiving cavities 221 extending vertically and arranged at regular intervals along a longwise direction thereof. Each first receiving cavity 221 longitudinally passes through the corresponding insert board 22 to communicate with the receiving recess 25 and the corresponding receiving space 26. Each of the sidewalls 23 defines a plurality of first fixing perforations 231 vertically passing therethrough and corresponding to the first receiving cavities 221. Two sides of the base board 21 define a plurality of first receiving grooves 211 extending longitudinally to connect the first receiving cavities 221 and the corresponding first fixing perforations 231. Each first receiving groove 211 further passes through the base board 21 vertically and communicates with the corresponding receiving space 26. The first receiving groove 211, the corresponding first fixing perforation 231 and the corresponding first receiving cavity 221 together define a first passageway 27.

Figure 6:
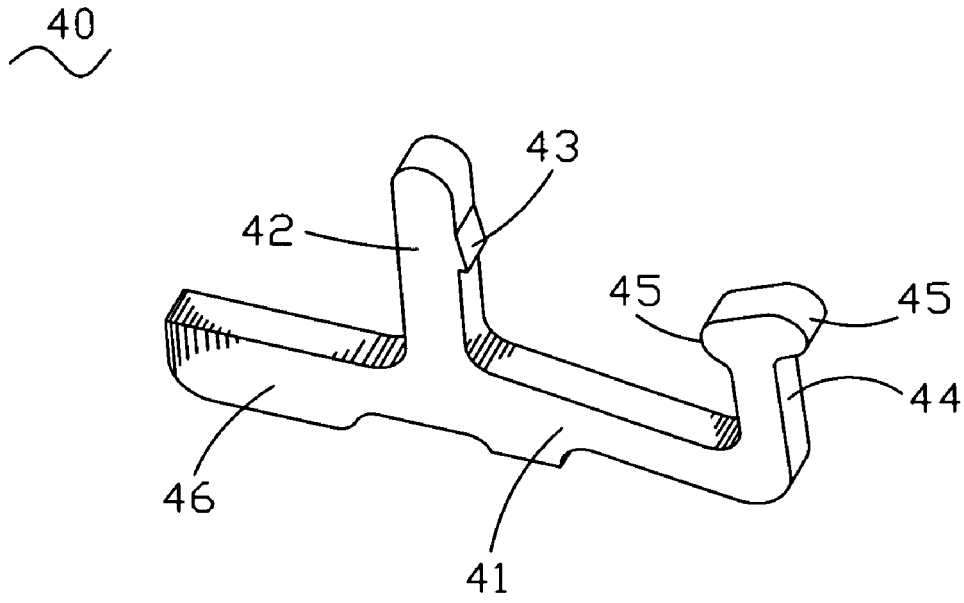
FIG. 6 is a perspective view of a first terminal of the board-to-board connector assembly of FIG. 1.

In FIG. 6, each of the first terminals 40 has a first base portion 41 extending longitudinally. Two opposite ends of the first base portion 41 extend upward to form a first fixing portion 42 and a propping portion 44 respectively. The first fixing portion 42 protrudes outward to form a first fixing hook 43. Two sides of a top end of the propping portion 44 protrudes oppositely to form two contact portions 45, one of which facing the first fixing portion 42 is lower than the other opposite the first fixing portion 42. One end of the first base portion 41 further extends longitudinally to form a first soldering portion 46 adjacent to the first fixing portion 42.

Figure 7:
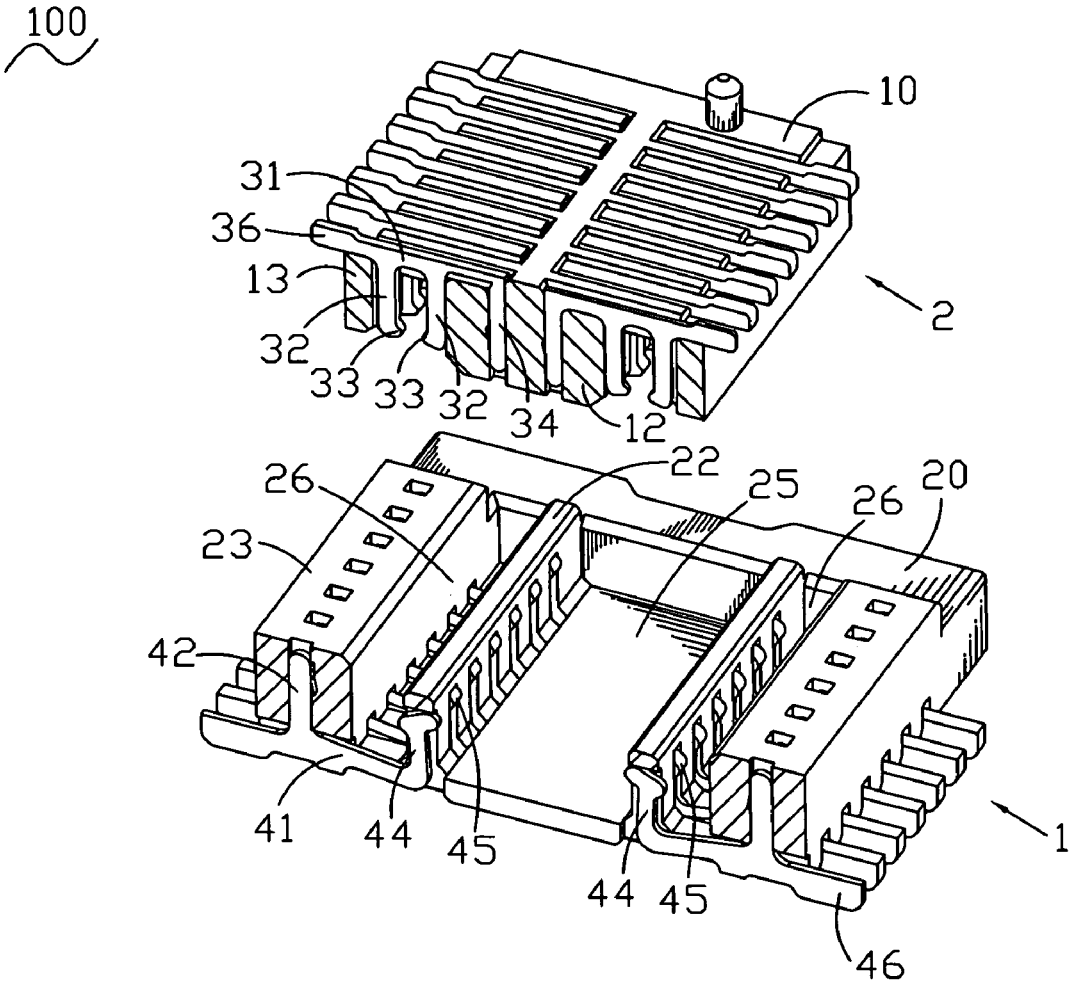
FIG. 7 is a cross-sectional view of the board-to-board connector assembly having a receptacle connector and a plug connector separated from each other.
Figure 8:
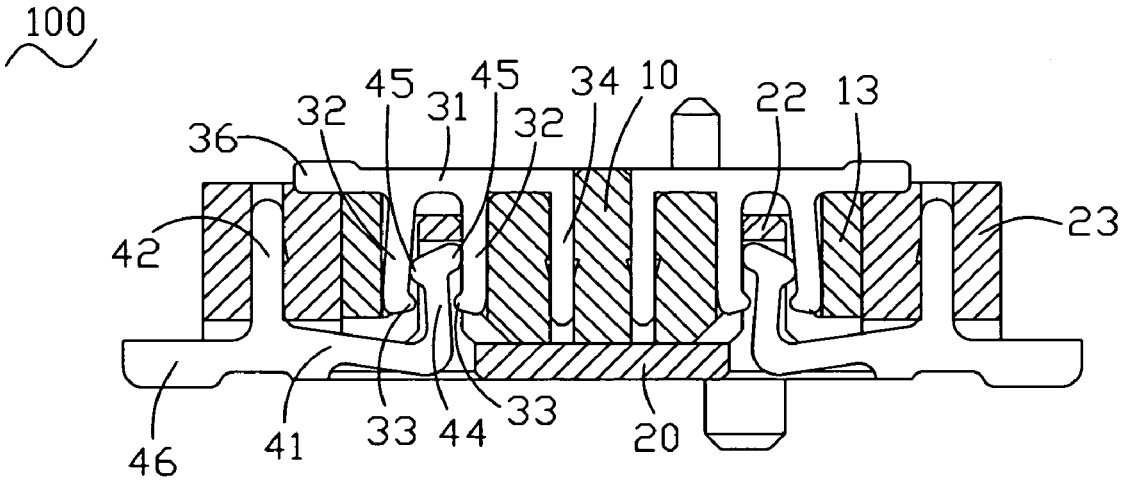
FIG. 8 is a cross-sectional view of the board-to-board connector assembly along line VIII-VIII of FIG. 1.

In FIG. 7, when the receptacle connector 1 is to be assembled, the first terminals 40 are received in the corresponding first passageways 27 of the receptacle housing 20. The first base portion 41 is received in the corresponding first receiving groove 211. The first fixing portion 42 is inserted in the corresponding first fixing perforation 231 and the first fixing hook 43 abuts against an inner of the first fixing perforation 231. The propping portion 44 is received in the corresponding first receiving cavity 221 and the two contact portions 45 respectively stretch into the receiving recess 25 and the corresponding receiving space 26. The first soldering portion 46 longitudinally stretches out of the corresponding sidewall 23.

Referring to FIGS. 2, 3, 5 and 7, the plug connector 2 includes a plug housing 10 mated with the receptacle housing 20 and a plurality of second terminals 30 disposed in the plug housing 10 respectively.

The plug housing 10 has a rectangular base plate 11 disposed levelly. Two opposite sides of the base plate 11 protrude downward to form a pair of side plates 13 extending longwise. A middle portion of the base plate 11 protrudes downward to form an insert wall 12 paralleling the two side plates 13. Accordingly, two receiving channels 15 are respectively formed between the insert wall 12 and the corresponding side plates 13. The insert wall 12 defines two rows of second fixing perforations 121 arranged at regular intervals along a longwise direction thereof and vertically passing therethrough. Two opposite sides of the insert wall 12 and an inside of each side plate 13 define a plurality of second receiving cavities 131 vertically passing therethrough and communicating with the corresponding receiving channels 15. Two sides of the base plate 11 define a plurality of second receiving grooves 111 extending longitudinally to connect the corresponding two second receiving cavities 131 and the corresponding second fixing perforation 121. Each second receiving groove 111 further passes through the base plate 11 vertically and communicates with the corresponding receiving channel 15. The second receiving groove 111, the corresponding second fixing perforation 121 and the corresponding two second receiving cavities 131 together define a second passageway 14.

Figure 5:
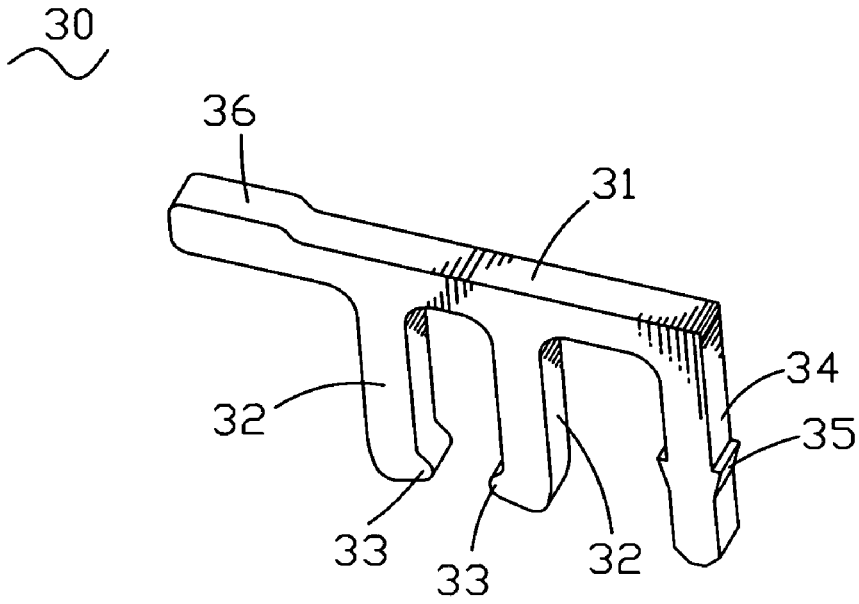
FIG. 5 is a perspective view of a second terminal of the board-to-board connector assembly of FIG. 1.

In FIG. 5, each of the second terminals 30 has a second base portion 31 extending longitudinally. One end of the second base portion 31 extends downward to form a second fixing portion 34 and the other end thereof extends longitudinally to form a second soldering portion 36. The second fixing portion 34 oppositely protrudes outward to form two second fixing hooks 35. The second base portion 31 further extends downward to form two contact arms 32, one of which is located adjacent to the second soldering portion 36 and the other is substantially located at a middle of the second base portion 31. Two bottom ends of the two contact arms 32 protrude face-to-face to respectively form an interference portion 33.

When the plug connector 2 is to be assembled, the second terminals 30 are received in the corresponding second passageways 14 of the plug housing 10. The second base portion 31 is received in the corresponding second receiving groove 111. The second fixing portion 34 is inserted in the corresponding second fixing perforation 121 and the second fixing hooks 35 abut against an inner of the second fixing perforation 121. The two contact arms 32 are respectively received in the corresponding second receiving cavities 131 and the interference portions 33 stretch face-to-face into the corresponding receiving channel 15. The second soldering portion 36 longitudinally stretches out of the corresponding side plate 13.

Referring to FIGS. 1, 2, 7 and 8, when the plug connector 2 is engaged with the receptacle connector 1, the insert wall 12 of the plug housing 10 is received in the receiving recess 25 of the receptacle housing 20, the side plates 13 are inserted in the corresponding receiving spaces 26, and the insert boards 22 are inserted in the corresponding receiving channels 15. The contact portions 45 of the first terminal 40 are clipped between the contact arms 32 of the corresponding second terminal 30 to electrically contact the corresponding contact arms 32 tightly such that ensures the first terminal 40 and the corresponding second terminal 30 electrically connected with each other steadily.

In process of the plug connector 2 being engaged with the receptacle connector 1, the two contact portions 45 can pass the corresponding interference portions 33 one after another because of being located at different heights that facilitates the contact portions 45 to be received between the contact arms 32. Moreover, when the board-to-board connector assembly 100 is shaken in use, the interference portions 33 can cooperate with the corresponding contact portions 45 to prevent the first terminal 40 from departing from the corresponding second terminal 30. Therefore, the first terminals 40 can be always electrically connected with the corresponding second terminals 30 steadily.

As described above, the contact portions 45 of the first terminal 40 are clipped between the contact arms 32 of the corresponding second terminal to electrically contact the corresponding contact arms 32 tightly such that ensures the first terminal 40 and the corresponding second terminal 30 electrically connected with each other steadily. Furthermore, the interference portions 33 have an interference with the corresponding contact portions 45 that prevents the first terminal 40 from departing from the corresponding second terminal 30 and further ensures the first terminal 40 and the corresponding second terminal 30 electrically connected with each other steadily even if the board-to-board connector assembly 100 is shaken.

What is claimed is:

1. A board-to-board connector assembly, comprising:

a receptacle connector having a receptacle housing defining a plurality of first passageways, and a plurality of first terminals received in the corresponding first passageways, each of the first terminals having a first base portion extending longitudinally, the first base portion extending upward to form a propping portion, two sides of a top end of the propping portion protruding oppositely to form two contact portions stretching out of the corresponding first passageway; and a plug connector mated with the receptacle connector and having a plug housing defining a plurality of second passageways, and a plurality of second terminals received in the corresponding second passageways and each having a second base portion extending longitudinally, the second base portion extending downward to form two contact arms spaced from each other, two bottom ends of the two contact arms protruding face-to-face to respectively form an interference portion stretching out of the corresponding second passageway;

wherein the contact portions of the first terminal pass the interference portions of the corresponding second terminal to be clipped between and in electrical contact with the corresponding contact arms respectively.

2. The board-to-board connector assembly as claimed in claim 1, wherein one of the contact portions of the first terminal is located to be lower than the other contact portion.

3. The board-to-board connector assembly as claimed in claim 1, wherein one end of the first base portion extends upward to form a first fixing portion and extends longitudinally to form a first soldering portion stretching out of the receptacle housing, the propping portion is defined on the other end of the first base portion.

4. The board-to-board connector assembly as claimed in claim 1, wherein one end of the second base portion extends downward to form a second fixing portion and the other end thereof extends longitudinally to form a second soldering portion stretching out of the plug housing, one of the contact arms is adjacent to the second soldering portion.

5. The board-to-board connector assembly as claimed in claim 1, wherein the receptacle housing has a base board, two opposite sides of the base board protrude upward to form a pair of sidewalls extending longwise, two opposite ends of the base board protrude upward to form a pair of end-walls, the base board further protrudes upward to form two insert boards paralleling the sidewalls and spaced away from each other, two opposite ends of each insert board are connected with the corresponding end-walls, a receiving recess is formed among the insert boards and the end-walls, and two receiving spaces are respectively formed among the insert boards, the corresponding sidewalls and the end-walls.

6. The board-to-board connector assembly as claimed in claim 5, wherein the plug housing has a base plate, two opposite sides of the base plate protrude downward to form a pair of side plates extending longwise and inserted in the corresponding receiving spaces, the base plate further protrudes downward to form an insert wall paralleling the side plates and received in the receiving recess, two receiving channels are respectively formed between the insert wall and the corresponding side plates for receiving the corresponding insert boards of the receptacle housing therein.

7. The board-to-board connector assembly as claimed in claim 6, wherein each of the first passageways has a first receiving cavity defined vertically in the insert board for receiving the propping portion therein, and a first receiving groove defined longitudinally in the base board to connect the corresponding first receiving cavity for receiving the first base portion therein, the contact portions of each first terminal respectively stretch into the receiving recess and the corresponding receiving space.

8. The board-to-board connector assembly as claimed in claim 6, wherein each of the second passageways has two second receiving cavities face-to-face defined vertically in an outside of the insert wall and an inside of the corresponding side plate and communicating with the corresponding receiving channel for receiving the corresponding contact arms therein, and a second receiving groove defined longitudinally in the base plate to connect the two corresponding second receiving cavities for receiving the second base portion therein, the interference portions of each second terminal face-to-face stretch into the corresponding receiving channel.

* * * * *